US009777945B2

(12) United States Patent
Pan

(10) Patent No.: US 9,777,945 B2
(45) Date of Patent: Oct. 3, 2017

(54) ADJUSTABLE WASHING RACK FOR AIR CONDITIONER

(71) Applicant: Chang-An Pan, Changhua (TW)

(72) Inventor: Chang-An Pan, Changhua (TW)

( * ) Notice: Subject to any disclaimer, the term of this patent is extended or adjusted under 35 U.S.C. 154(b) by 213 days.

(21) Appl. No.: 14/840,401

(22) Filed: Aug. 31, 2015

(65) Prior Publication Data

US 2017/0059200 A1 Mar. 2, 2017

(51) Int. Cl.
*F24F 13/32* (2006.01)

(52) U.S. Cl.
CPC ..... *F24F 13/32* (2013.01)

(58) Field of Classification Search
CPC ..... F24F 13/32
USPC ..... 137/312; 220/571
See application file for complete search history.

(56) References Cited

U.S. PATENT DOCUMENTS 4,812,700 A * 3/1989 Natale ..... B08B 9/023 134/21
5,725,009 A * 3/1998 Mallow, Sr. ..... F16L 55/18 137/312
5,775,869 A * 7/1998 Bishop ..... E01B 19/006 137/312
5,881,566 A * 3/1999 Shacklock ..... F25D 21/14 165/46
6,978,909 B2 * 12/2005 Goetzinger ..... F24F 13/222 220/571
8,104,634 B2 * 1/2012 Gregg ..... E03C 1/182 220/571
8,439,060 B1 * 5/2013 Jackson ..... F16L 41/12 137/312

* cited by examiner

*Primary Examiner* — Eric Keasel
(74) *Attorney, Agent, or Firm* — Alan D. Kamrath; Kamrath IP Lawfirm, P.A.

(57) ABSTRACT

An adjustable washing rack for an air conditioner contains: a body and a water collection bag. The body includes two opposite supports, a first adjusting rod, and a fixing rod. Each support has a first connecting portion, a rotatable coupling portion, and a second connecting portion. The first adjusting rod is defined between two first connecting portions of the two supports and has a first outer fitting extension and a first inner fitting extension. The fixing rod has a second outer fitting extension and two second inner fitting extensions. The each second inner fitting extension has a first end coupled with a connector for rotatably connecting with the rotatable coupling portion of the each support, and a positioning device is mounted between the connector and the rotatable coupling portion of the each support. The water collection bag includes an opening and a U-shaped surrounding part.

8 Claims, 11 Drawing Sheets

ADJUSTABLE WASHING RACK FOR AIR CONDITIONER

BACKGROUND OF THE INVENTION

Field of the Invention

The present invention relates to an adjustable washing rack for an air conditioner, and more particularly to an adjustable washing rack adapted for a detachable air conditioner mounted on a wall in a room.

Description of the Prior Art

Conventional detachable air conditioner contains an outdoor part and at least one indoor part. The outdoor part is in connection with the at least one indoor part through a connection pipe, and the indoor part is mounted on a wall in a room and has a body. The indoor part also has an inlet, an outlet, and plural fins. However, it is easy to accumulate dusts and bacterium in the body, and (chilly) gas discharges out of the air outlet when the body operates, thus producing poor air quality and damaging health. It is essential to wash the indoor part of the detachable air conditioner regularly. As washing the indoor part, it is troublesome to remove the indoor part from the wall because of a heavy weight of the indoor part.

To overcome above-mentioned problems, a washing rack is employed to hang the indoor part so that the indoor part is directly cleaned on the wall. The washing rack for the air conditioner contains a body and a water collection bag, wherein the water collection bag has an opening facing upwardly so that the body expends and hangs the water collection bag on a peripheral side of the indoor part, and water sprays the indoor part from the opening. Preferably, the water collection bag holds water flowing from the indoor part.

Nevertheless, the body of the washing rack is fixed and cannot be adjusted according to widths of various indoor parts. In other words, the conventional washing rack is merely applicable for a fixed width of the indoor part, thus having high washing cost. When washing the indoor part, the opening of the water collection bag cannot be adjusted based on desiring washing position of the indoor part, so the water splashes out of the opening of the water collection bag easily as washing an upper portion of the indoor part to get surroundings or furniture humid. In addition, the water collection bag interferes washing jobs as washing a lower portion of the indoor part.

The present invention has arisen to mitigate and/or obviate the afore-described disadvantages.

SUMMARY OF THE INVENTION

The primary objective of the present invention is to provide an adjustable washing rack for an air conditioner which adjusts heights of various air conditioners based on using requirements to reduce operation cost.

Further objective of the present invention is to provide an adjustable washing rack for an air conditioner which flexibly adjusts a height of a water collection bag by rotating a fixing rod to avoid water splashing out of the water collection bag and interfering the water collection bag as washing the air conditioner.

Another objective of the present invention is to provide an adjustable washing rack for an air conditioner in which a body is pulled outwardly or is retracted inwardly based on a width of the air conditioner, and the fixing rod is rotated to adjust the height of the water collection bag and to position the water collection bag easily.

Accordingly, an adjustable washing rack for an air conditioner provided by the present invention contains: a body and a water collection bag.

The body includes two opposite supports, each support is disposed on each of two sides of the body, and the body also includes a first adjusting rod and a fixing rod, wherein each support has a first connecting portion, a rotatable coupling portion, and a second connecting portion, wherein the first connecting portion is formed on an upper end of the each support, the rotatable coupling portion is disposed on an outer surface of the each support, and the second connecting portion is arranged on a lower end of the each support, the first adjusting rod is defined between two first connecting portions of the two supports and has a first outer fitting extension and a first inner fitting extension movably fitted with the first outer fitting extension, such that a length of the first adjusting rod is adjustable by changing a connection length of the first outer fitting extension and the first inner fitting extension, the fixing rod is formed in a U shape, and it has a second outer fitting extension and two second inner fitting extensions which are fitted with the second outer fitting extension, such that a connection length of the second outer fitting extension and the two second inner fitting extensions is adjustable, the each second inner fitting extension has a first end coupled with a connector for rotatably connecting with the rotatable coupling portion of the each support, and a positioning device is mounted between the connector and the rotatable coupling portion of the each support, such that the fixing rod rotates along the connector to adjust its angle and is fixed by the positioning device.

The water collection bag includes an opening facing upwardly, and the water collection bag includes a U-shaped surrounding part extending upwardly from a front end and two sides thereof, wherein a rear side of the main part couples with the two second connecting portions of the two supports, and a top of the surrounding part connects with the fixing rod of the body.

DETAILED DESCRIPTION OF THE PREFERRED EMBODIMENTS

Figure 1:
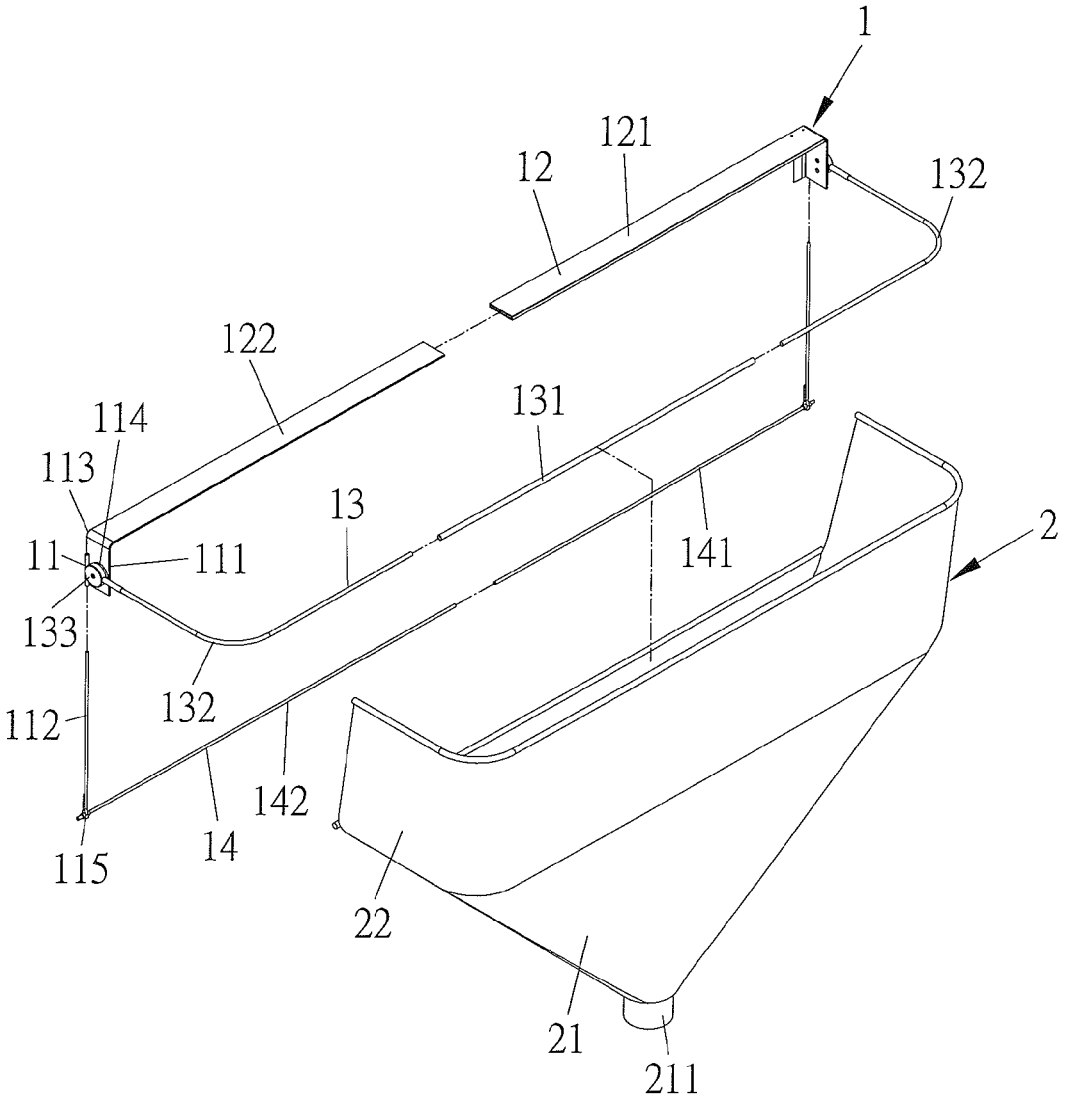
FIG. 1 is a perspective view showing the exploded components of an adjustable washing rack for an air conditioner according to a preferred embodiment of the present invention.
Figure 2:
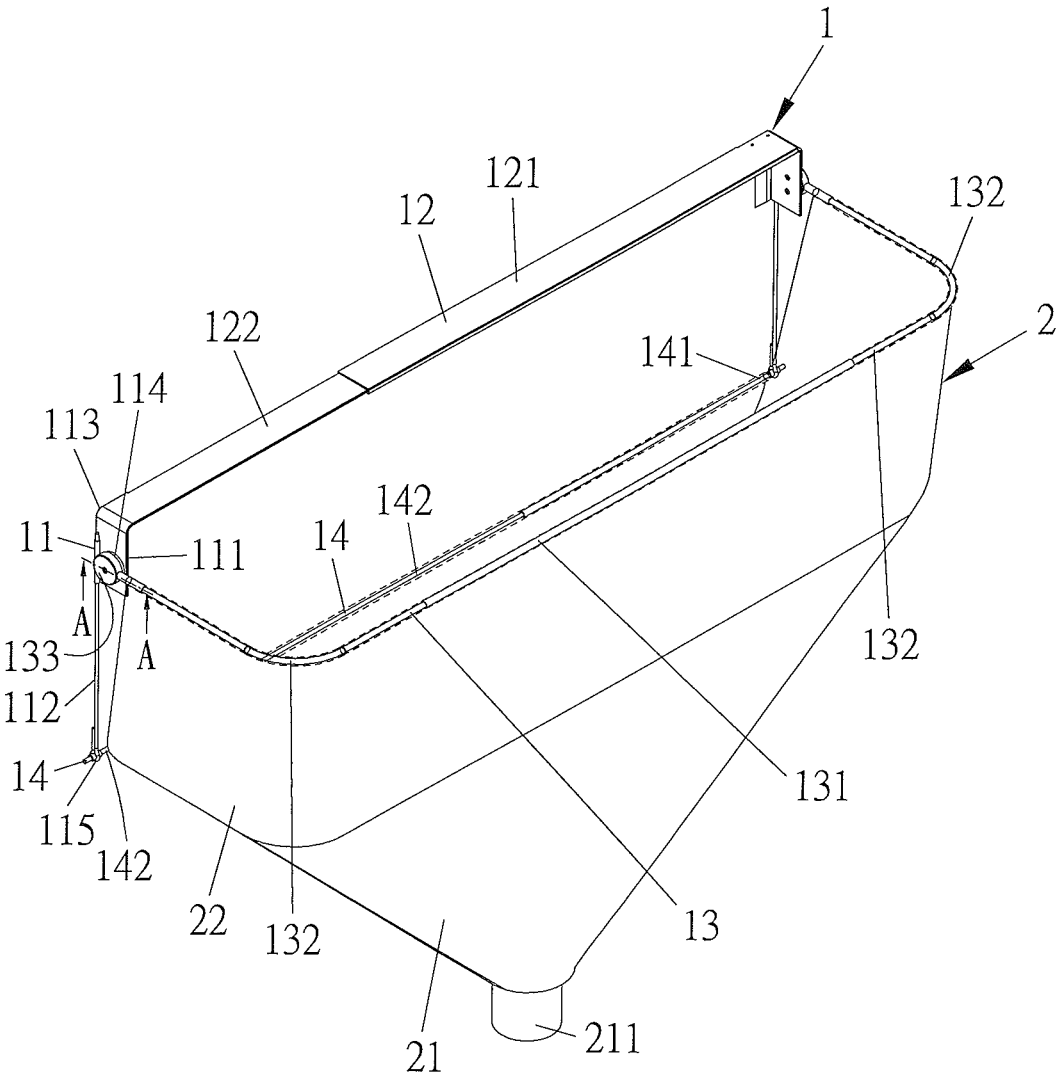
FIG. 2 is a perspective view showing the assembly of the adjustable washing rack for the air conditioner according to the preferred embodiment of the present invention.
Figure 3:
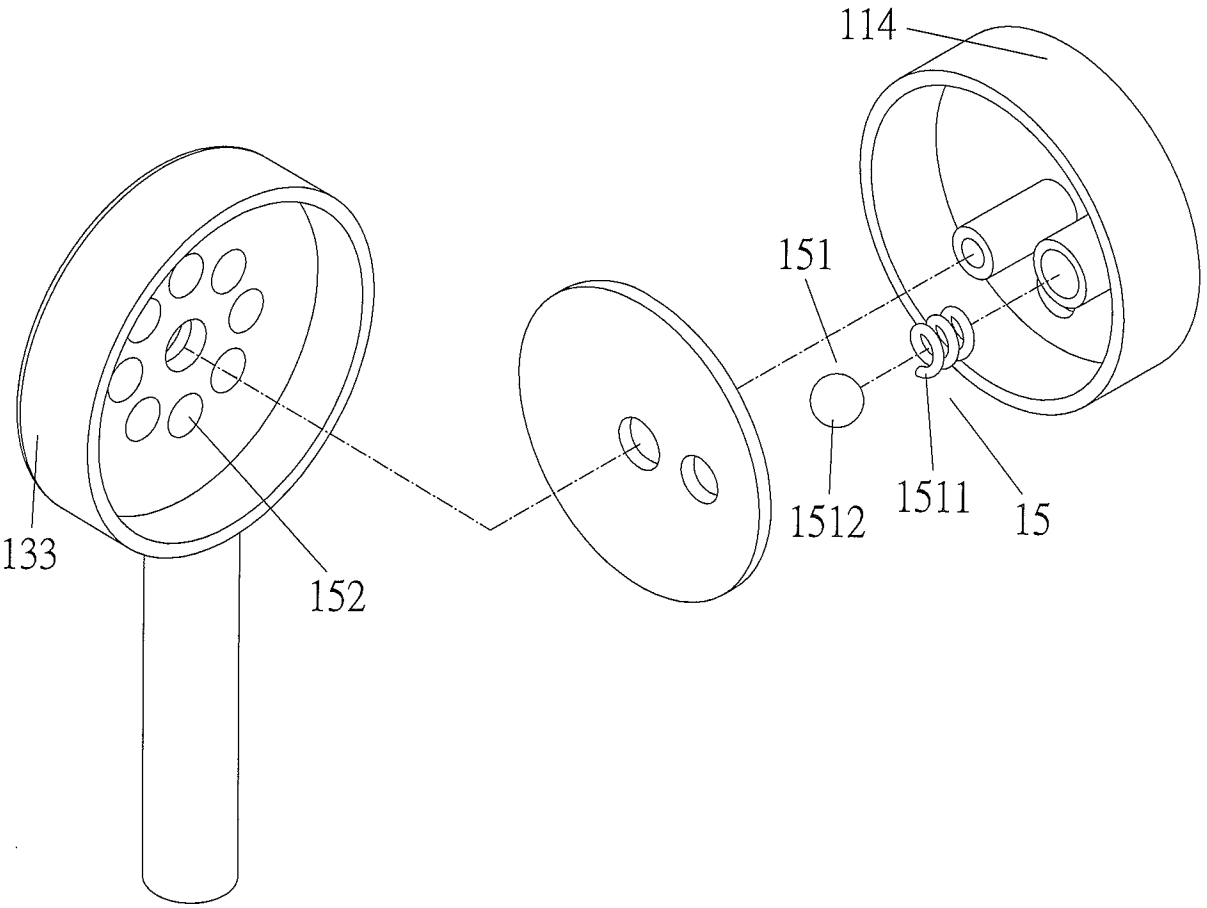
FIG. 3 is a perspective view showing the exploded components of a positioning device of the adjustable washing rack for the air conditioner according to the preferred embodiment of the present invention.
Figure 4:
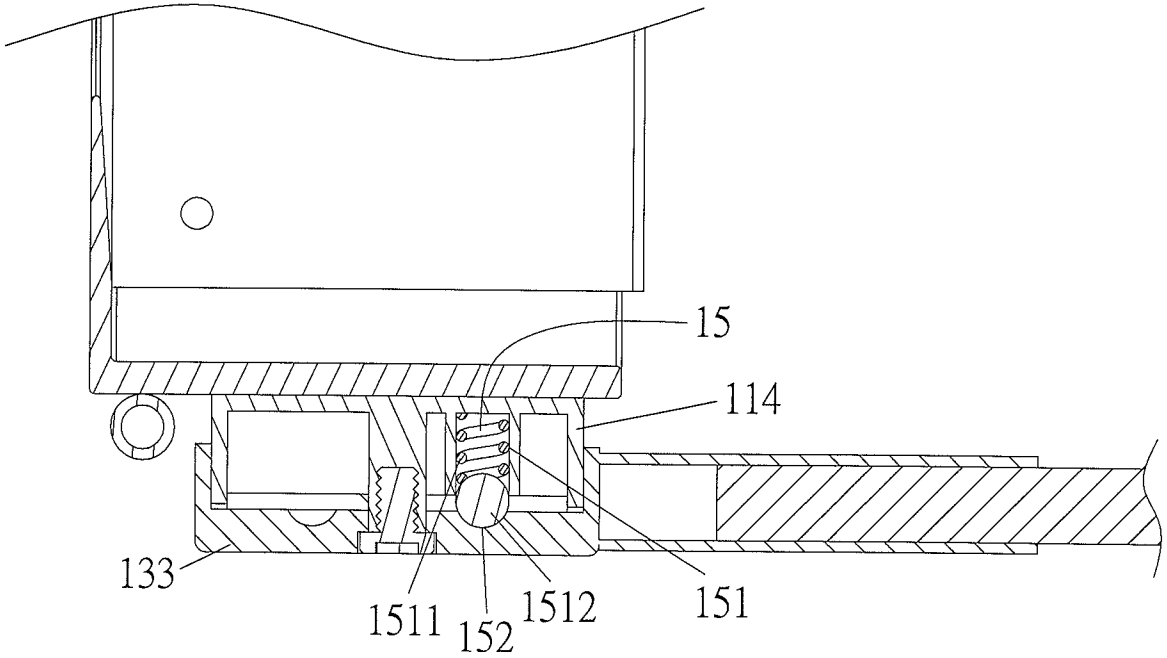
FIG. 4 is a cross sectional view taken along lines A-A of FIG. 2.

The present invention will be clearer from the following description when viewed together with the accompanying drawings, which show, for purpose of illustrations only, the preferred embodiment in accordance with the present invention.

With reference to FIGS. 1 to 4, an adjustable washing rack for an air conditioner according to a preferred embodiment of the present invention comprises: a body 1 and a water collection bag 2, wherein the body 1 includes two opposite supports 11, each support 11 is disposed on each of two sides of the body 1, and the body 1 also includes a first adjusting rod 12, a fixing rod 13, and a second adjusting rod 14. Each support 11 has a side plate 111 and a hanging member 112 connected with and extending downwardly from the side plate 111, and the side plate 111 has a first connecting portion 113 formed on an upper end thereof and has a rotatable coupling portion 114 disposed on an outer surface thereof, the hanging member 112 has a second connecting portion 115 arranged on a lower end thereof. The first adjusting rod 12 is defined between two first connecting portions 113 of the two supports 11 and has a first outer fitting extension 121 and a first inner fitting extension 122 movably fitted with the first outer fitting extension 122, such that a length of the first adjusting rod 12 is adjustable by changing a connection length of the first outer fitting extension 121 and the first inner fitting extension 122. The fixing rod 13 is formed in a U shape, and it has a second outer fitting extension 131 arranged on a middle section thereof and two second inner fitting extensions 132, each second inner fitting extension 132 is fixed on each of two ends of the fixing rod 13 and is formed in an L shape. The each second inner fitting extension 132 has a first end coupled with a connector 133 for rotatably connecting with the rotatable coupling portion 114 of the each support 11, such that a rotatable angle is defined between the side plate 111 of the each support 11 and the each second inner fitting extension 132 of the fixing rod 13. The each second inner fitting extension 132 has a second end fitted with the second outer fitting extension 131, such that a connection length of the each second inner fitting extension 132 and the second outer fitting extension 131 is adjustable. A positioning device 15 is mounted between the connector 133 and the rotatable coupling portion 114 of the each support 11, and the positioning device 15 has an elastic retaining unit 151 and plural concave notches 152 annularly arranged thereon, wherein the elastic retaining unit 151 has a spring 1511 and a steel ball 1512 which are fixed on the rotatable coupling portion 114, and the plural concave notches 152 are annularly arranged on the connector 133, such that the steel ball 1512 of the elastic retaining unit 151 is pushed by the spring 1511 to fix in one of the plural concave notches 152 and moves into another of the plural concave notches 152 as the connector 133 rotates, hence the fixing rod 13 rotates along the connector 133 to adjust its angle and is fixed by the positioning device 15. The second adjusting rod 14 is fixed between two second connecting portions 115 of the two opposite supports 11, and the second adjusting rod 14 has a third outer fitting extension 141 and a third inner fitting extension 142 fitted with the third outer fitting extension 141, such that a length of the second adjusting rod 14 is adjustable by changing a connection length of the third outer fitting extension 141 and the third inner fitting extension 142. The water collection bag 2 is made of waterproof fabric and includes a main part 21, wherein the main part 21 has an opening facing upwardly, and the water collection bag 2 includes a U-shaped surrounding part 22 extending upwardly from a front end and two sides thereof, a rear side of the main part 21 couples with the two second connecting portions 115 of the two supports 11 by fitting with two second adjusting rods 14 of the two supports 11 (or by binding with the two second adjusting rods 14), a top of the surrounding part 22 connects with the body 1 by fitting with the fixing rod 13 (or by binding with the fixing rod 13). In addition, the main part 21 has a draining fitting 211 secured on a bottom thereof.

Figure 5:
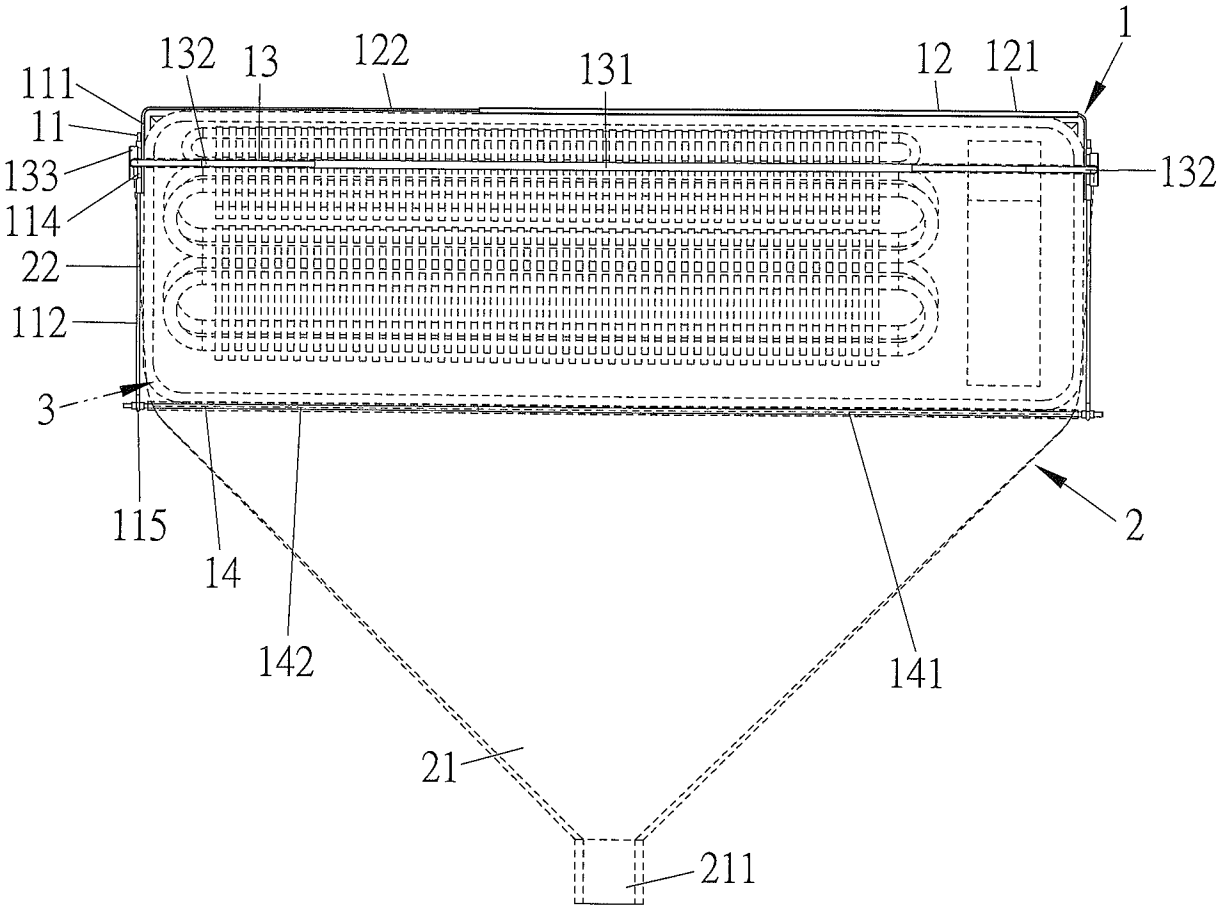
FIG. 5 is a front side view showing the application of the adjustable washing rack for the air conditioner according to the preferred embodiment of the present invention.
Figure 6:
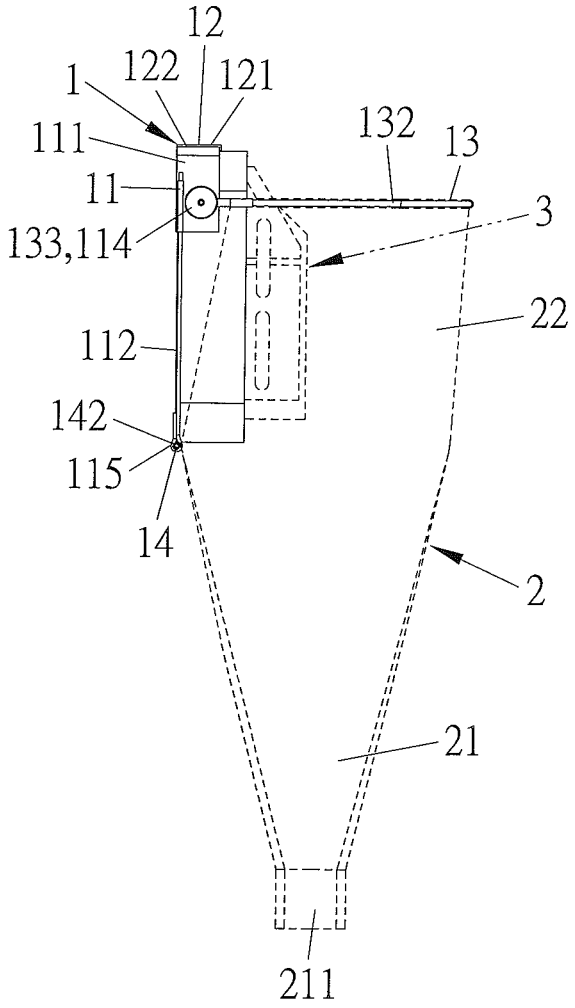
FIG. 6 is a side plane view showing the application of the adjustable washing rack for the air conditioner according to the preferred embodiment of the present invention.
Figure 7:
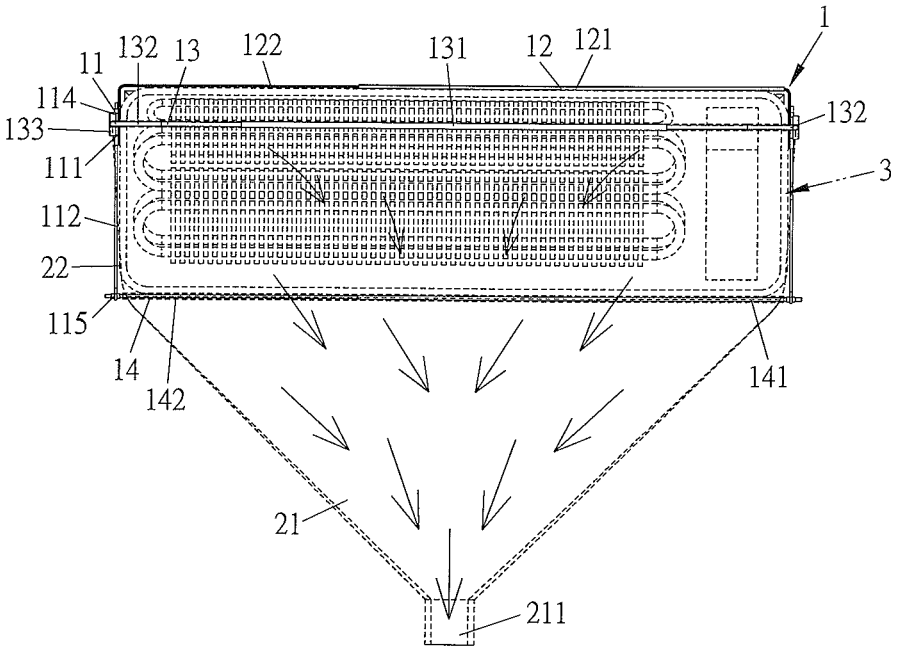
FIG. 7 is a side plane view showing the operation of the adjustable washing rack for the air conditioner according to the preferred embodiment of the present invention.

In operation, as shown in FIGS. 5 and 6, a front cover of an air conditioner 3 is removed to expose plural fins and an air outlet of the air conditioner 3, and the body 1 is fitted on the air conditioner 3 so that a part of the side plate 111 of the each support 11 of the body 1 is fixed between each of two sides of the side plate 111 and a wall, and another part of the side plate 111 of the each support 11 and the hanging member 112 contact with two peripheral surfaces of the air conditioner 3, the first adjusting rod 12 of the body 1 contacts with a top of the air conditioner 3 and the wall, the two second adjusting rods 14 of the two supports 11 of the body 1 abut against a bottom of the air conditioner 3 and the wall, the fixing rod 13 of the body 1 extends toward a front side of the air conditioner 3, and the surrounding part 22 of the water collection bag 2 surrounds around the air conditioner 3, wherein the main part 21 of the water collection bag 2 is located below the air conditioner 3, and a water discharge tube (not shown) is connected with the draining fitting 211. Referring to FIG. 7, the plural fins and the air outlet of the air conditioner 3 are sprayed by water, and the water does not splash surroundings or furniture near the air conditioner 3 by ways of the surrounding part 22 of the water collection bag 2. Preferably, water flowing from the air conditioner 3 is held by the water collection bag 2 and discharges out of the water discharge tube via the draining fitting 211 of the main part 21.

Figure 8:
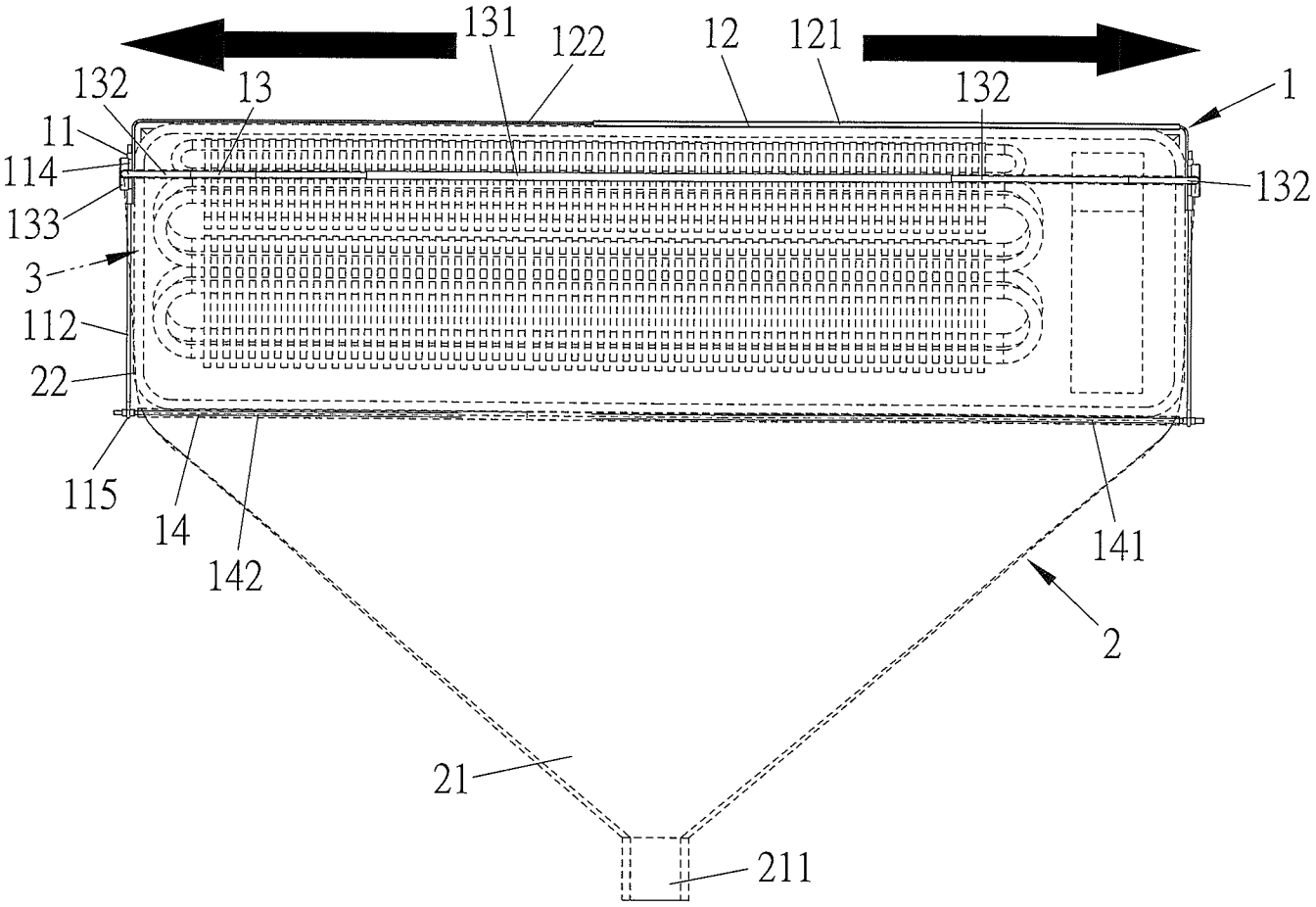
FIG. 8 is a side plane view showing the adjustable washing rack for the air conditioner being pulled outwardly according to the preferred embodiment of the present invention.
Figure 9:
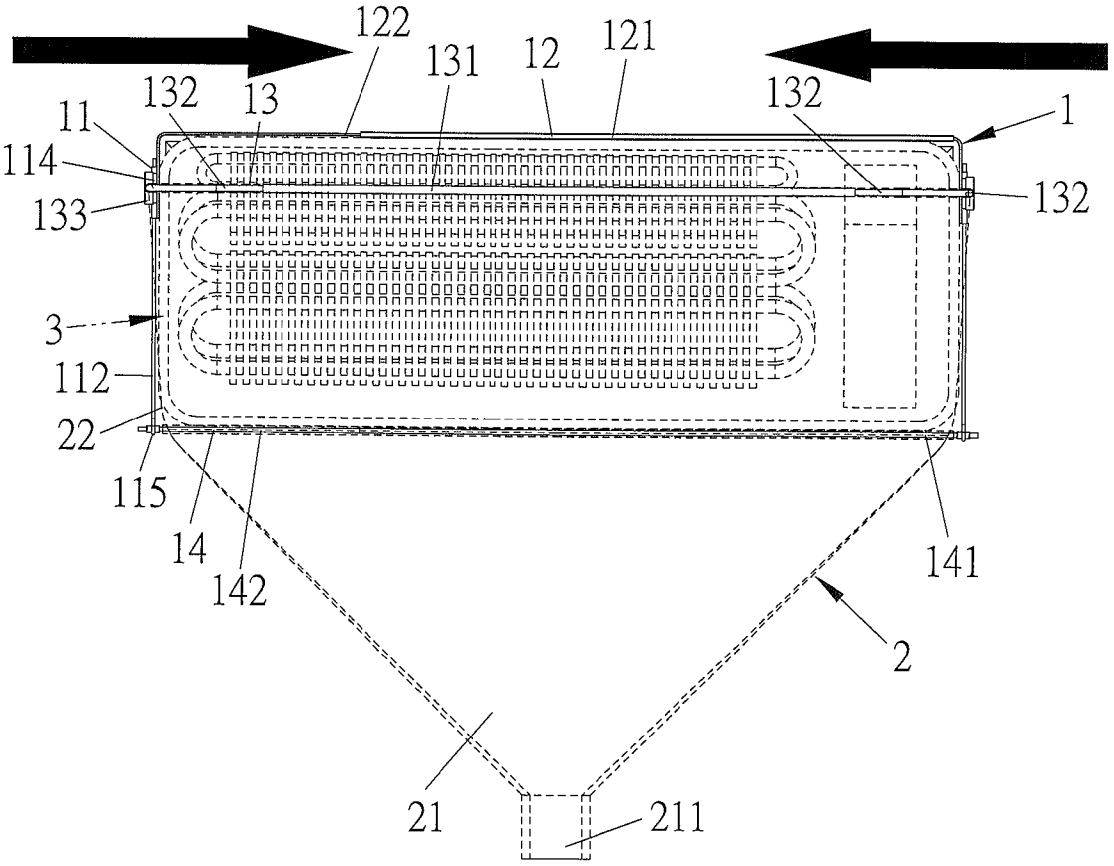
FIG. 9 is a side plane view showing the adjustable washing rack for the air conditioner being retracted inwardly according to the preferred embodiment of the present invention.

With reference to FIGS. 8 and 9, the two supports 11 of the body 1 are moved away from or close to each other so that the first outer fitting extension 121 and the first inner fitting extension 122 of the first adjusting rod 12 and the third outer fitting extension 141 and the third inner fitting extension 142 of the second adjusting rod 14 move away from or close to each other simultaneously, and the two second inner fitting extensions 132 of the fixing rod 13 expand or retract relative to the second outer fitting extension 131 of the fixing rod 13, hence a width of the body 1 is adjusted to correspond to a width of the air conditioner 3, thus complying with various using requirements.

Figure 10:
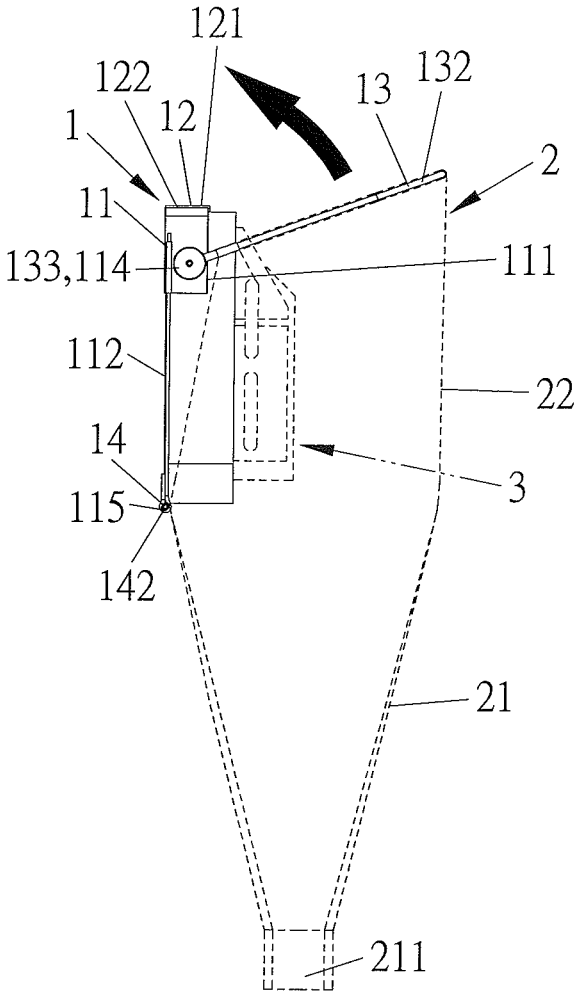
FIG. 10 is a side plane view showing a water collection bag of the adjustable washing rack for the air conditioner being moved upwardly according to the preferred embodiment of the present invention.
Figure 11:
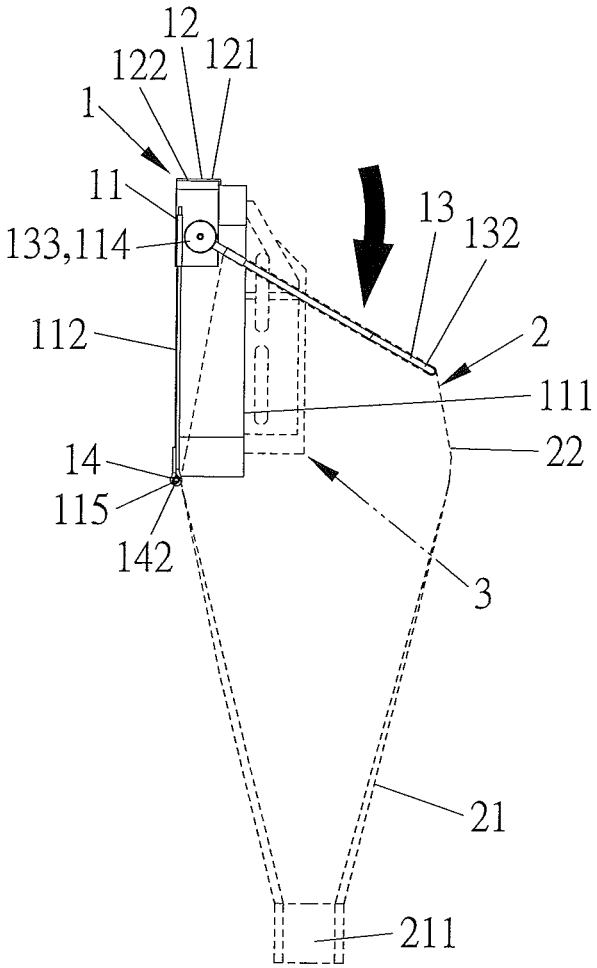
FIG. 11 is a side plane view showing the water collection bag of the adjustable washing rack for the air conditioner being moved downwardly according to the preferred embodiment of the present invention.

Referring further to FIGS. 10 and 11, a height of the water collection bag 2 is adjusted based on a desiring washing portion of the air conditioner 3. For example, when washing an upper portion of the air conditioner 3, the each support 13 of the body 1 is rotated upwardly and is fixed by the positioning device 15, hence the surrounding part 22 of the water collection bag 2 is raised by rotating the each support 13 upwardly to avoid the water spraying out of the water collection bag 2. As washing a lower portion of the air conditioner 3, the each support 13 of the body 1 is rotated downwardly and is fixed by the positioning device 15, hence the surrounding part 22 of the water collection bag 2 is descended by rotating the each support 13 downwardly to avoid interfering the water collection bag 2 and to clean the air conditioner 3 easily.

In another preferred embodiment, the elastic retaining unit 151 of the positioning device 15 is positioned on the connector 133, and the plural concave notches 152 are arranged on the rotatable coupling portion 114 to obtain above-mentioned functions.

The hanging member 112 is flexible to avoid contacting with a connection pipe of the air conditioner 3 and to adjust a height of the air conditioner 3.

Therefore, the adjustable washing rack for the air conditioner contains benefits as follows:

1. The body 1 is pulled outwardly or is retracted inwardly to adjust its width according to the width of the air conditioner 3, thus complying with the various using requirements and reducing operation cost.

2. The height of the water collection bag 2 is adjusted based on the desiring washing portion of the air conditioner 3. For instance, when washing the upper portion of the air conditioner 3, the water collection bag 2 is raised by rotating the each support 13 upwardly to avoid the water spraying out of the water collection bag 2. As washing the lower portion of the air conditioner 3, the water collection bag 2 is descended by rotating the each support 13 downwardly to prevent interfering with the water collection bag 2 and to clean the air conditioner 3 easily.

3. The body 1 is pulled outwardly or is retracted inwardly to adjust its width according to the width of the air conditioner 3, and the each support 13 is rotated upwardly or downwardly to raise or descend the height of the water collection bag 2, thereafter the each support 13 is fixed by the positioning device 15, thus adjusting and fixing the water collection bag 2 easily.

While we have shown and described various embodiments in accordance with the present invention, it is clear to those skilled in the art that further embodiments may be made without departing from the scope of the present invention.

What is claimed is:

1. An adjustable washing rack for an air conditioner comprising:

a body, wherein the body includes two opposite supports, each support is disposed on each of two sides of the body, and the body also includes a first adjusting rod and a fixing rod, wherein each support has a first connecting portion, a rotatable coupling portion, and a second connecting portion, wherein the first connecting portion is formed on an upper end of the each support, the rotatable coupling portion is disposed on an outer surface of the each support, and the second connecting portion is arranged on a lower end of the each support, the first adjusting rod is defined between two first connecting portions of the two supports and has a first outer fitting extension and a first inner fitting extension movably fitted with the first outer fitting extension, such that a length of the first adjusting rod is adjustable by changing a connection length of the first outer fitting extension and the first inner fitting extension, the fixing rod is formed in a U shape, and it has a second outer fitting extension and two second inner fitting extensions which are fitted with the second outer fitting extension, such that a connection length of the second outer fitting extension and the two second inner fitting extensions is adjustable, the each second inner fitting extension has a first end coupled with a connector for rotatably connecting with the rotatable coupling portion of the each support, and a positioning device is mounted between the connector and the rotatable coupling portion of the each support, such that the fixing rod rotates along the connector to adjust its angle and is fixed by the positioning device; and a water collection bag including a main part which has an opening facing upwardly, and the water collection bag also including a U-shaped surrounding part extending upwardly from a front end and two sides of the main part, wherein a rear side of the main part couples with the two second connecting portions of the two supports, and a top of the surrounding part connects with the fixing rod of the body.

2. The adjustable washing rack for the air conditioner as claimed in claim 1, wherein the body has a second adjusting rod fixed between two second connecting portions of the two opposite supports, and the second adjusting rod has a third outer fitting extension and a third inner fitting extension fitted with the third outer fitting extension, such that a length of the second adjusting rod is adjustable by changing a connection length of the third outer fitting extension and the third inner fitting extension, and a rear side of the main part couples with the two second connecting portions of the two supports by fitting with two second adjusting rods of the two supports.

3. The adjustable washing rack for the air conditioner as claimed in claim 1, wherein the each support has a side plate and a hanging member connected with and extending downwardly from the side plate.

4. The adjustable washing rack for the air conditioner as claimed in claim 3, wherein the hanging member is flexible to avoid contacting with a connection pipe of the air conditioner.

5. The adjustable washing rack for the air conditioner as claimed in claim 3, wherein the hanging member is flexible to avoid contacting with a connection pipe of the air conditioner and to adjust heights of various air conditioners.

6. The adjustable washing rack for the air conditioner as claimed in claim 1, wherein the positioning device has an elastic retaining unit and plural concave notches annularly arranged thereon, the elastic retaining unit has a spring and a steel ball which are fixed on the rotatable coupling portion, and the plural concave notches are annularly arranged on the connector, such that the steel ball of the elastic retaining unit is pushed by the spring to fix in one of the plural concave notches and moves into another of the plural concave notches as the connector rotates.

7. The adjustable washing rack for the air conditioner as claimed in claim 1, wherein a top of the surrounding part of the water collection bag connects with the body by fitting with the fixing rod.

8. The adjustable washing rack for the air conditioner as claimed in claim 1, wherein the main part of the water collection bag has a draining fitting secured on a bottom thereof.

* * * * *